United States Patent [19]

Beyer

[11] 3,931,488

[45] Jan. 6, 1976

[54] MULTIPLE SWITCH ACTUATOR

[75] Inventor: Edward T. Beyer, Rosamond, Calif.

[73] Assignee: The United States of America as represented by the United States Energy Research and Development Administration, Washington, D.C.

[22] Filed: June 20, 1950

[21] Appl. No.: 169,241

[52] U.S. Cl. ..... 200/331; 102/81.6; 200/5 R; 200/153 M; 200/161; 200/329; 200/332

[51] Int. Cl.² ..... H01H 3/20; H01H 17/00; F42C 15/12

[58] Field of Search ..... 200/169.1, 169, 169 PB, 200/331, 332, 329, 330, 5 R, 153 M, 161; 102/70.2, 70 S, 81.6, 64, 70.2 R, 64

[56] References Cited

UNITED STATES PATENTS

| | | | |
|---|---|---|---|
| 2,255,927 | 9/1941 | Huber et al. | 200/330 |
| 2,516,163 | 7/1950 | Vaughan | 200/332 |
| 2,646,487 | 7/1953 | Johnson | 200/331 |

*Primary Examiner*—Maynard R. Wilbur
*Assistant Examiner*—Gregory E. Montone
*Attorney, Agent, or Firm*—Roland A. Anderson; Ralph Carlisle Smith

[57] ABSTRACT

The present invention relates to switches and switch actuating devices to be operated for purposes of arming a bomb or other missile as it is dropped or released from an aircraft. The particular bomb or missile in which this invention is applied is one in which there is a plurality of circuits which are to be armed by the closing of switches upon dropping or releasing of the bomb. The operation of the switches to closed position is normally accomplished by means of a pull-out wire; that is, a wire which is withdrawn from the bomb or missile at the time of release of the bomb, one end of the wire being attached to the aircraft. The conditions to be met are that the arming switches must be positively and surely maintained in open position until the bomb is released and the arming action is effected. The action of the pull-out wire in achieving the arming action must be sure and positive with minimum danger of malfunctioning, jamming or binding.

1 Claim, 2 Drawing Figures

WITNESSES:

Edward C. Walsh

Louis F. Jacob

INVENTOR:

Edward T. Beyer

BY

Roland A. Anderson

Attorney

MULTIPLE SWITCH ACTUATOR

In accordance with the foregoing it is the primary object of my invention to provide a switch assembly including multiple switches adapted for arming a bomb or other missile which can be conveniently operated by means of a pull-out wire or equivalent operating device.

Another object of the invention is to provide a multiple switch assembly adapted for arming a bomb or similar missile comprising a plurality of snap acting switches having means including a wire normally restraining the switches in open position, the wire being operable to be withdrawn longitudinally for releasing the switches to permit the operation to closed position.

Another object of the invention is to provide a switch assembly as in the foregoing object wherein each of the plurality of switches is provided with a resilient cantilever arm which is normally held in engagement with the switch actuator when the pull-out wire is in position and which moves away to allow the switch to operate to closed position when the pull-out wire is withdrawn.

Further objects and numerous of the advantages of my invention will become apparent from the following detailed description and annexed drawing wherein.

Figure 1:
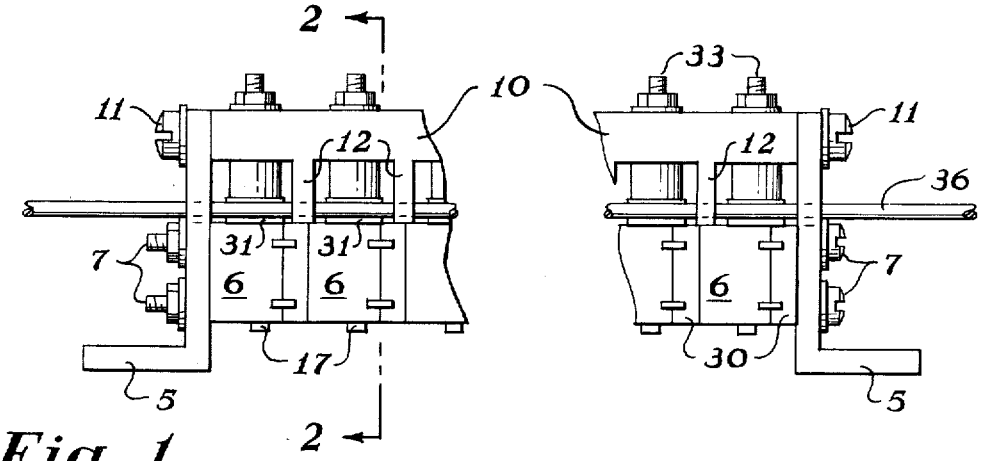
FIG. 1 is a side elevational view partly broken away of the switch assembly.

Referring to FIG. 1 of the drawings, the assembly comprises a pair of end brackets 5 having horizontal feet as shown. Disposed between these end brackets in side by side relationship are the individual switch units 6, the assembly being held together by through bolts 7 which extend through openings 8 (FIG. 2) in the switch units and through aligned openings in the end brackets 5. Also disposed between the upper ends of the end brackets 5 is a rigid bar 10 which is secured in position by screws 11 extending through the end brackets. The rigid bar 10 has downwardly extending ribs 12 which extend downwardly to the assembly of switch units.

Figure 2:
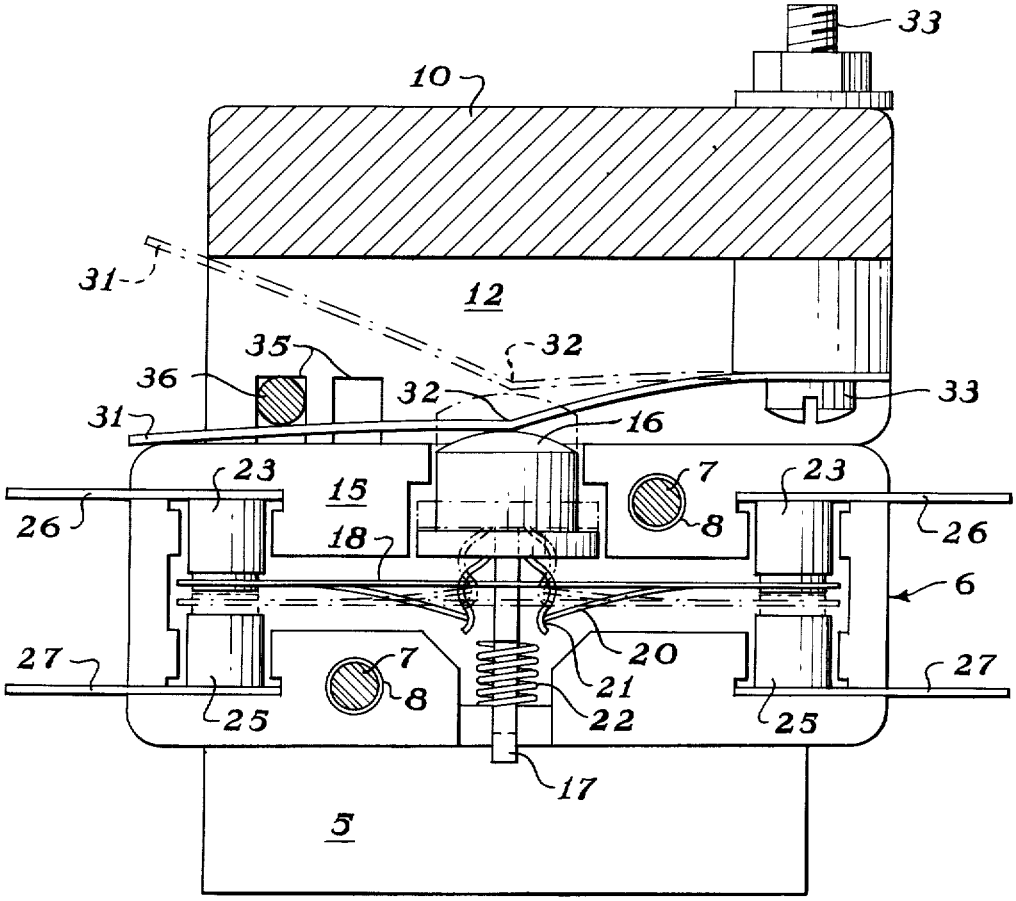
FIG. 2 is an enlarged sectional view taken along the line of 2—2 of the FIG. 1.

Each individual switch unit 6 as may be seen in FIG. 2 comprises an insulative frame member 15 which has interior openings of the shape as shown in FIG. 2. These openings comprise a horizontal portion as shown to enclose a switch contact bar; intermediate cut away portions to accommodate a push button and operating stem, and cut away portions adjacent the ends to accommodate contact members as will be described.

The switching mechanism comprises a push button 16 situated in an intermediate cut away portion of the frame 15 and movable to a position above the top level of the frame 15. The push button 16 has a stem 17 movable in a guide channel in the lower part of the frame 15. The switch mechanism comprises a horizontal contact bar 18 which has attached thereto resilient strips 20 which form toggle arms as will be described. Secured to the bottom of the push button 16 is an inverted U-shaped spring member 21 and this member has crimped portions at the ends of its legs as shown which receive the inner ends of the toggle arms 20. Encircling the stem 17 is a coiled biasing spring 22 the upper end of which engages a shoulder on stem 17 normally urging the stem and push button 16 upwardly. The contact bar 18 carries contacts at its ends in a position movable between upper and lower contacts 23 and 25 disposed within the cut away portions at the ends of the frame 15. The upper and lower contact members 23 and 25 are attached to contact strips 26 and 27 which extend outwardly through grooves or slots formed in the frame 15.

With the parts as shown in full lines, the contacts at the ends of the contact bar 18 are in engagement with the upper contacts 23. The biasing spring 22 normally urges the parts into the position shown in dotted lines. When the button 16 is released to move upwardly the parts move into the dotted line position and when this happens the toggle arms 20 move from a position deformed below the bar 18 to a position deformed above the bar 18 and this movement is with a snap action, the member 21 being resilient to permit springing inwardly of its legs.

When the snap action occurs the contacts at the ends of the bar 18 are snapped downwardly into engagement with the contacts 25.

As may be seen in FIG. 1 each switch unit has a cover plate 30 which completes the unit and the contact strips 26 and 27 engage in complementary slots or grooves formed in these cover plates.

Overlying each of the push buttons 16 is a resilient flat cantilever spring member 31 having a central bend 32 which engages the top of its respective push button. The fixed end of each of these springs is attached to the rigid cross member 10 by means of a bolt 33, the end of the spring 31 being spaced from the cross member 10 by a spacer member as shown.

Each of the downwardly extending ribs 12 has at its lower part a pair of rectangular grooves or channels 35 and these channels are aligned transversely as respects the assembly. With the individual switches in the position shown in full lines the push buttons are held down by the springs 31 and the springs 31 are restrained in position by means of an arming wire 36 extending through one of the series of channels 35. From the foregoing it can readily be observed that with the arming wire 36 in position all of the switches are restrained in the position as shown in full lines in FIG. 2, it being understood, of course, that the biasing spring 22 is normally urging the switches to the opposite position. Upon release and dropping of the bomb or missile the arming wire 36, one end of which is attached to the aircraft is withdrawn from the assembly and this releases all of the springs 31 in rapid sequence allowing the individual switches to operate to the opposite, that is, the dotted line position in which the contacts 25 are engaged for purposes of closing the various arming circuits. The contacts 23 may or may not be used and, if used, they would be effective to open various circuits upon the arming of the bomb.

From the foregoing those skilled in the art will observe that I have provided a very efficient and effective device for arming a plurality of circuits as a result of the dropping of a missile from an aircraft. The restraining of the switches in inactive position prior to the time of arming is positive and the manner of effecting arming action is positive without employing any parts susceptible to jamming, binding or other form of malfunctioning.

Various modifications and alternatives may be adopted by those skilled in the art without departing from the spirit and scope of the invention. For example, among other alternatives, the arming wire 36 while ordinarily being a flexible wire having considerable tensile strength, it might be in the form of a rigid pin or it might be a rigid pin connected at one end by a flexible wire or cable.

The foregoing disclosure is intended to be representative of a preferred form of the invention and it is intended that all proper modifications, alternatives and equivalents be encompassed in the scope of the claims appended hereto.

I claim:

1. The combination of a plurality of push-button switches and a lock-out device comprising an elongated support, means affixing the switches to the support in adjacent relation, said switches each being in an on condition when the push-button is in the out position, spring means urging each of the push-buttons in an out position, a plurality of parallel levers, one each for each of said switches, each lever being supported at one end on said elongated support and extending transversely over and beyond the respective switch push-button, an elongated groove adjacent the tops of the switches in said elongated support, a transverse groove in said elongated support for each of said levers and intersecting the elongated groove, a lockout wire extending through said elongated groove above the levers in their depressed position, whereby the push-buttons are likewise in depressed position, said lock-out wire adapted to be withdrawn to release the levers and permit each push-button spring means to actuate its corresponding switch.

* * * * *